US009801465B1

(12) United States Patent
Finch, Jr.

(10) Patent No.: US 9,801,465 B1
(45) Date of Patent: Oct. 31, 2017

(54) STORAGE SYSTEMS

(71) Applicant: John L. Finch, Jr., Naples, FL (US)

(72) Inventor: John L. Finch, Jr., Naples, FL (US)

( * ) Notice: Subject to any disclaimer, the term of this patent is extended or adjusted under 35 U.S.C. 154(b) by 0 days.

(21) Appl. No.: 15/278,858

(22) Filed: Sep. 28, 2016

(51) Int. Cl.
*A47B 51/00* (2006.01)
*A47B 45/00* (2006.01)

(52) U.S. Cl.
CPC ..... *A47B 51/00* (2013.01); *A47B 45/00* (2013.01)

(58) Field of Classification Search
CPC . A47B 46/005; A47B 2051/005; A47B 77/10; A47B 45/00; A47B 46/00
See application file for complete search history.

(56) References Cited

U.S. PATENT DOCUMENTS 3,729,245 A * 4/1973 Skifstrom ..... A47B 91/00 312/247
4,026,434 A * 5/1977 Howard ..... A47B 46/005 220/478
4,076,351 A * 2/1978 Wyant ..... A47B 46/005 248/280.11
4,134,629 A * 1/1979 Hansen ..... A47B 46/005 312/246
4,915,461 A * 4/1990 Kingsborough ..... A47B 77/10 312/247
5,058,846 A * 10/1991 Close ..... A47F 5/0087 211/104
5,224,677 A * 7/1993 Close ..... A47F 5/0087 211/104
5,228,763 A * 7/1993 Gingold ..... A47B 46/005 312/247
5,249,858 A * 10/1993 Nusser ..... A47B 46/005 312/248
5,308,158 A * 5/1994 Vogelgesang ..... A47B 77/10 211/170
5,560,501 A * 10/1996 Rupert ..... A47B 46/00 211/104
5,758,782 A * 6/1998 Rupert ..... A47B 46/00 211/104
5,857,756 A * 1/1999 Fehre ..... A47B 46/005 312/246
6,439,676 B1 * 8/2002 Badonic ..... D06F 95/002 312/212
6,468,015 B1 * 10/2002 Konstant ..... B65G 1/08 193/35 MD
6,471,311 B1 * 10/2002 Snyder ..... A47B 51/00 312/245
6,484,893 B1 * 11/2002 Tkatch ..... A47B 46/00 211/103
6,588,608 B2 * 7/2003 Pater ..... B65G 1/02 211/151
7,770,986 B1 * 8/2010 Simaitis ..... A47B 46/005 312/246

(Continued)

*Primary Examiner* — Patrick Hawn
(74) *Attorney, Agent, or Firm* — Thomas | Horstemeyer, LLP

(57) ABSTRACT

Disclosed are various embodiments of storage systems. In some embodiments, the storage system includes an upper frame, a guide tube that supports the upper frame, a pivot arm, and a side support. A first end of the pivot arm is rotatably coupled to the guide tube, and a second end of the pivot arm is rotatably coupled to a fixed pivot point. The side support includes a guide post that is inserted into the guide tube. The guide tube is configured to move along the guide post.

15 Claims, 14 Drawing Sheets

(56) References Cited

U.S. PATENT DOCUMENTS

| | | | | |
|---|---|---|---|---|
| 7,922,009 | B1 * | 4/2011 | Larson | B62H 3/08 211/17 |
| 7,922,268 | B2 * | 4/2011 | Weber | A47B 46/005 312/246 |
| 8,061,789 | B2 * | 11/2011 | Krueger | A47B 46/005 211/100 |
| 8,414,093 | B2 * | 4/2013 | Moran | A47B 51/00 312/246 |
| 8,424,983 | B1 * | 4/2013 | Strauss | A47B 51/00 312/247 |
| 8,950,592 | B1 * | 2/2015 | Greenblatt | B62H 3/08 211/17 |
| 8,985,344 | B2 * | 3/2015 | Larson | B62H 3/12 211/1.51 |
| 9,504,322 | B1 * | 11/2016 | McJunkin | A47B 81/00 |
| 9,510,675 | B2 * | 12/2016 | Baranski | A47B 46/005 |
| 2007/0236114 | A1 * | 10/2007 | Fuentes | A47B 46/005 312/246 |
| 2009/0289535 | A1 * | 11/2009 | Weber | A47B 46/005 312/317.1 |
| 2011/0012490 | A1 * | 1/2011 | Schwendemann | A47B 46/005 312/326 |
| 2012/0312760 | A1 * | 12/2012 | Larson | B62H 3/12 211/1.51 |

* cited by examiner

STORAGE SYSTEMS

BACKGROUND

Shelves can be used to store and display various types of items. For example, shelves in an automotive mechanic's garage can be used to store and display tools and automotive parts. In a warehouse, shelves can be used to store items that can be later retrieved and shipped to other locations. As another example, shelves in a residence can be used to store items such as food and cleaning products.

Shelves can be mounted on a support structure that positions at least some of the shelves, and items stored thereon, above the ground surface. If a shelf is high enough above the ground surface, it may be difficult for a person or machinery to access and retrieve items that are stored on the shelf.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1C:
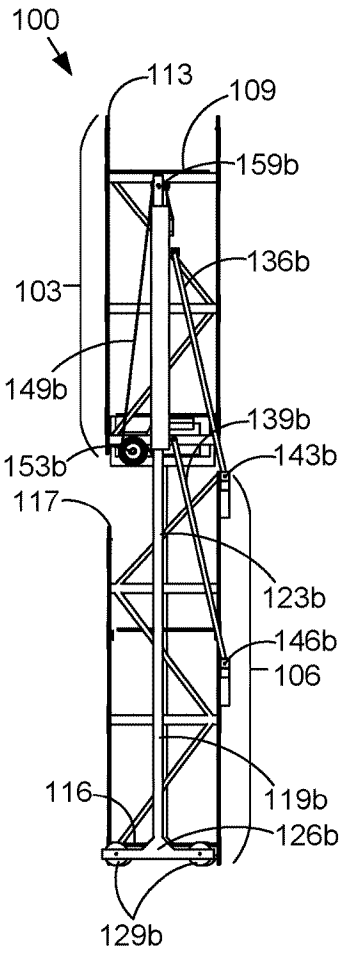
FIG. 1C shows a side view of the storage system of FIG. 1A.
Figure 1B:
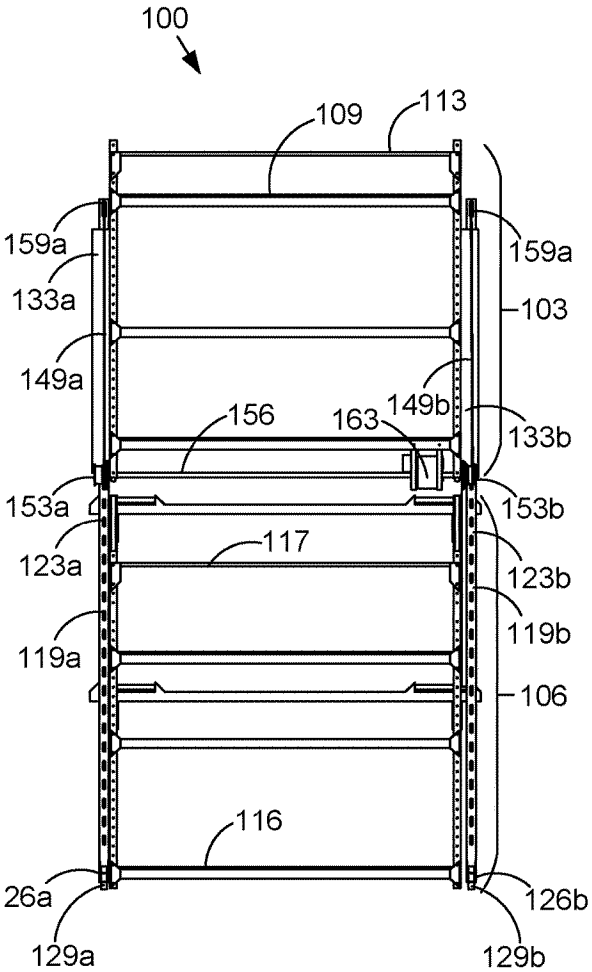
FIG. 1B shows a front view of the storage system of FIG. 1A.
Figure 1A:
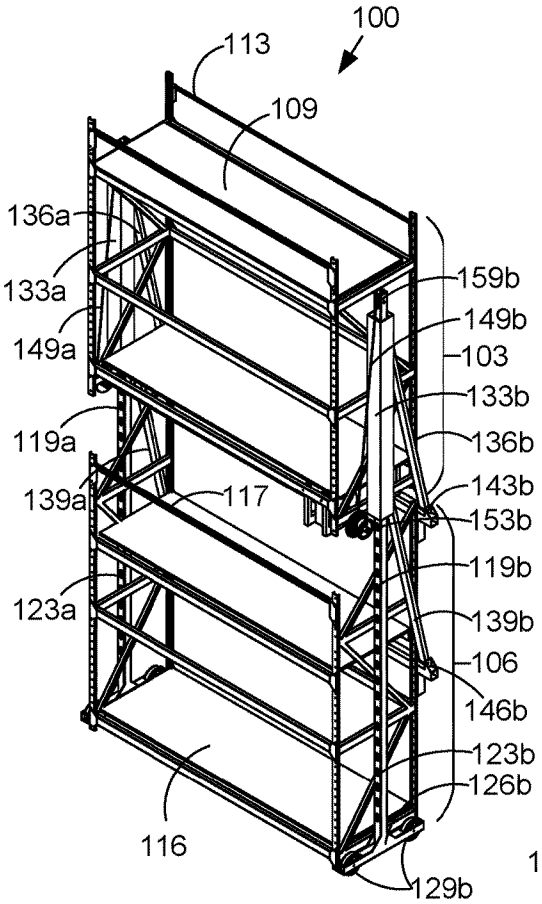
FIG. 1A shows a perspective view of a first example of a storage system according to various embodiments of the present disclosure.

The present disclosure relates to various types of storage systems. With reference to FIGS. 1A-1C, shown is a first example of a storage system 100 according to various embodiments of the present disclosure. In particular, FIG. 1A shows a perspective view, FIG. 1B shows a front view, and FIG. 1C shows a side view of the storage system 100.

The storage system 100 can include an upper frame 103 and a lower frame 106. As will be described in further detail below, the upper frame 103 can be lowered from the position shown in FIGS. 1A-1C in order to facilitate a person or machinery accessing various types of items that can be stored in the upper frame 103.

The upper frame 103 can include various types of components or structures that can be attached to the upper frame 103. For example, the embodiment shown includes shelves 109. In various embodiments, the positioning of the shelves 109 within the upper frame 103 can be adjusted. To this end, the upper frame 103 can include shelf brackets that can be mounted at various heights relative to the upper frame 103. In alternative embodiments, the upper frame 103 can include a floor or furniture, such as a couch, a bed, or seating.

The upper frame 103 can also include a ceiling bar 113. The ceiling bar 113 can prevent the storage of items that extend above the ceiling bar 113.

In some embodiments, the upper frame 103 can include a mounting surface, such as a pegboard, that facilitates mounting and displaying items. For example, a mounting surface can be positioned on the front side or the rear side of the upper frame 103, and items can be mounted or hung to the mounting surface.

Similar to the upper frame 103, the lower frame 106 can include one or more shelves 116, and the positions of the shelves 116 within the lower frame 106 can be adjusted using shelf brackets. The lower frame 106 can also include a mounting surface (not shown), such as a pegboard positioned on the front side or the rear side of the lower frame 106. In addition, the lower frame 106 can include a ceiling bar 117 that can prevent items that extend above the ceiling bar 117 from being stored in the lower frame 106.

In some embodiments, the lower frame 106 can be omitted. For example, instead of having the lower frame 106, the storage system 100 can include vertical supports that mount to a wall or other structure, similar to the embodiment depicted in FIGS. 5A-5B.

The storage system 100 can also include side supports 119*a*-119*b*. The side supports 119*a*-119*b* can include vertical guide posts 123*a*-123*b* and feet 126*a*-126*b*. In the embodiment shown in FIGS. 1A-1C, the guide posts 123*a*-123*b* have rectangular cross-sections. In alternative embodiments, the cross-sectional shape of the guide posts 123*a*-123*b* can be circular or any other suitable shape. The feet 126*a*-126*b* of the side supports 119*a*-119*b* can include wheels 129*a*-129*b* that facilitate the side supports 119*a*-119*b* traveling horizontally along a ground surface. In alternative embodiments, the side supports 119*a*-119*b* can include tracks, low-friction surfaces, or other components that facilitate movement of the side supports 119*a*-119*b* along the ground surface.

As illustrated in FIGS. 1A-1C, the storage system can also include hollow guide tubes 133*a*-133*b*. In the embodiment shown, the guide tubes 133*a*-133*b* have rectangular cross-sections. However, the cross-sectional shape of the guide tubes 133*a*-133*b* can be circular or any other suitable shape in other embodiments.

The guide tubes 133*a*-133*b* can support the upper frame 103 by being attached directly or indirectly to the upper frame 103. For example, the guide tubes 133*a*-133*b* can be welded directly to the upper frame 103.

As shown in FIGS. 1A-1C, the guide posts 123*a*-123*b* of the side supports 119*a*-119*b* can insert into and extend through the respective guide tubes 133*a*-133*b*. As will be described in further detail below, the guide tubes 133*a*-133*b* can move vertically along the guide posts 123*a*-123*b* in order to lower the upper frame 103. In some embodiments, the interior surfaces of the guide tubes 133*a*-133*b* can include a low-friction surface that can facilitate movement of the guide tubes 133*a*-133*b* along the guide posts 123*a*-123*b* of the side supports 119*a*-119*b*. Additionally, wheels, rollers, or tracks can be positioned within the guide tubes 133*a*-133*b* to facilitate movement of the guide tubes 133*a*-133*b* along the guide posts 123*a*-123*b*.

The guide tubes 133*a*-133*b* can be attached to upper pivot arms 136*a*-136*b* and lower pivot arms 139*a*-139*b*, respectively. In the embodiment shown in FIGS. 1A-1C, the ends of the upper pivot arms 136*a*-136*b* that are proximal to the guide tubes 133*a*-133*b* are rotatably coupled to the guide tubes 133*a*-133*b*. Similarly, the ends of the lower pivot arms 139*a*-139*b* that are proximal to the guide tubes 133*a*-133*b* are rotatably coupled to the guide tubes 133*a*-133*b*. As such, when the guide tubes 133*a*-133*b* move vertically along the guide posts 123*a*-123*b*, the upper pivot arms 136*a*-136*b* and the lower pivot arms 139*a*-139*b* can pivot relative to the guide tubes 133*a*-133*b*, while the guide tubes 133*a*-133*b* remain vertical.

The ends of the upper pivot arms 136*a*-136*b* that are distal relative to the guide tubes 133*a*-133*b* can be rotatably mounted to respective fixed points 143*a*-143*b*. For example, in the embodiment shown in FIGS. 1A-1C, the distal ends of the upper pivot arms 136*a*-136*b* are rotatably mounted to points on a horizontal bar that is attached to the top portion of the lower frame 106. In alternative embodiments, the distal ends of the upper pivot arms 136*a*-136*b* can be rotatably mounted to fixed points 143*a*-143*b* located on a wall or other support structure positioned behind the storage system 100.

Similarly, the ends of the lower pivot arms 139*a*-139*b* that are distal relative to the guide tubes 133*a*-133*b* can be rotatably mounted to respective fixed points 146*a*-146*b*. In the embodiment shown, the distal ends of the lower pivot arms 139*a*-139*b* are rotatably mounted to a bar that is attached to the rear of the lower frame 106. Alternatively, the distal ends of the lower pivot arms 139*a*-139*b* can be rotatably mounted to fixed points 143*a*-143*b* located on a wall or other support structure positioned behind the storage system 100.

The storage system 100 can include various types of structures that can cause the guide tubes 133*a*-133*b* to move vertically along the guide posts 123*a*-123*b* of the side supports 119*a*-119*b*. For example, the embodiment shown in FIGS. 1A-1C includes a cable system that can cause the guide tubes 133*a*-133*b* to move vertically along the guide posts 123*a*-123*b*. In various examples, the cable system can include cables 149*a*-149*b*, cable drums 153*a*-153*b*, a rod 156, pulleys 159*a*-159*b*, and a motor 163.

The motor 163 can rotate the rod 156, which is coupled to the cable drums 153*a*-153*b*. One end of each of the cables 149*a*-149*b* can be attached to a respective cable drum 153*a*-153*b*. In addition, the other end of each of the cables 149*a*-149*b* can be attached to a respective guide tube 133*a*-133*b* via one or more pulleys 159*a*-159*b*. Thus, when the motor 163 rotates the rod 156, the cables 149*a*-149*b* can wind or unwind around the cable drums 153*a*-153*b*. By winding or unwinding the cables 149*a*-149*b* around the cable drums 153*a*-153*b*, the cables 149*a*-149*b* can cause the guide tubes 133*a*-133*b* to move vertically along the guide posts 123*a*-123*b* of the side supports 119*a*-119*b*. Although FIGS. 1A-1C show that each cable 149*a*-149*b* passes around a respective pulley 159*a*-159*b*, each cable 149*a*-149*b* can pass around multiple pulleys 159*a*-159*b* in other embodiments.

In an alternative embodiment, the storage system 100 can include actuators that move the guide tubes 133*a*-133*b* vertically along the guide posts 123*a*-123*b*. For example, linear actuators can be attached to the guide tubes 133*a*-133*b* and the side supports 119*a*-119*b* and cause the guide tubes 133*a*-133*b* to move along the guide posts 123*a*-123 when the linear actuators extend or retract.

In an alternative embodiment, one or more motors can be mounted to one or more of the upper pivot arms 136*a*-136*b* or the lower pivot arms 139*a*-139*b*. The motors can rotate the upper pivot arms 136*a*-136 and lower pivot arms 139*a*-139*b* about the respective fixed points 143*a*-143*b* and 146*a*-146*b*, thereby causing the guide tubes 133*a*-133*b* to move vertically along the guide posts 123*a*-123*b* of the side supports 119*a*-119*b*.

Next, a general description of an example of the operation of the storage system 100 is provided. The following discussion assumes that the storage system 100 is first configured in the position shown in FIGS. 1A-1C. In this configuration, the upper frame 103 is positioned above the ground surface and above the lower frame 106. As shown in FIG. 1C, the upper frame 103 is also aligned vertically with the lower frame 106. Furthermore, the side supports 119*a*-119*b* are positioned to the sides of the lower frame 106 such that the side supports 119*a*-119*b* are aligned with the lower frame 106.

Figure 2B:
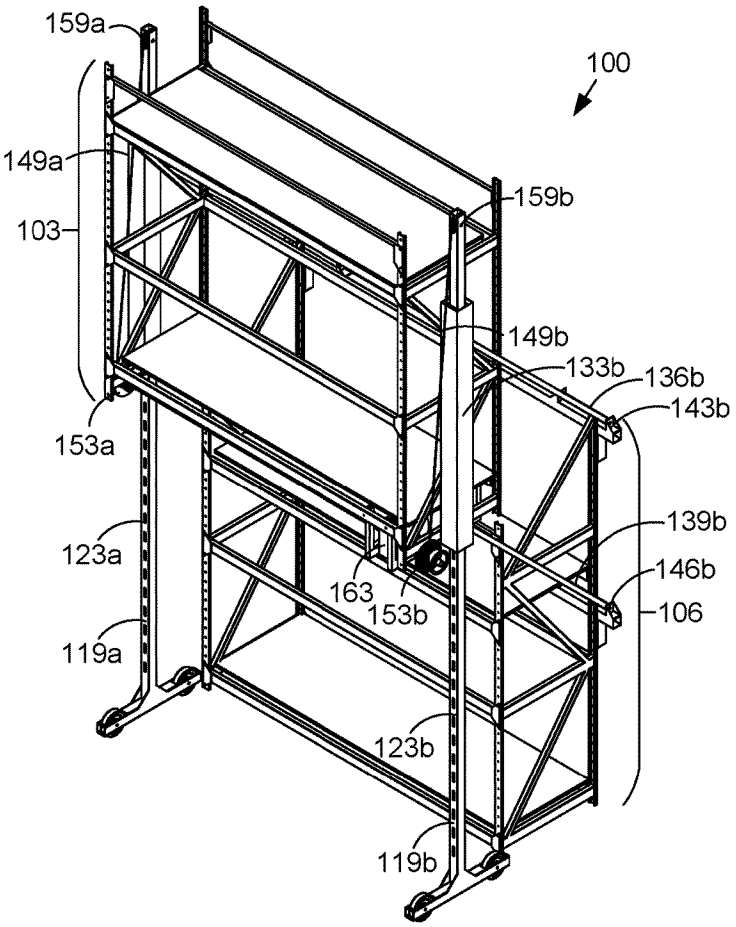
FIGS. 2A-2B, 3A-3B, and 4A-4B show the storage system of FIG. 1A in various configurations.
Figure 2A:
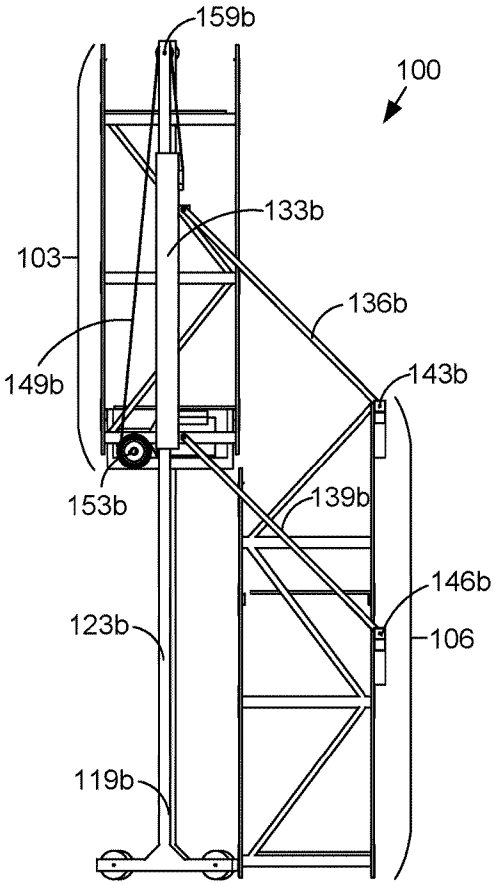

With reference to FIGS. 2A-2B, shown is the storage system 100 as the upper frame 103 is being lowered. For the storage system 100 to move from the configuration shown in FIGS. 1A-1C to the configuration shown in FIGS. 2A-2B, the motor 163 can rotate the cable drums 153*a*-153*b* so that the cables 149*a*-149*b* partially unwind from the cable drums 153*a*-153*b*. As a result, the lengths of the portions of the cables 149*a*-149*b* that extend from the cable drums 153*a*-153*b* to the pulleys 159*a*-159*b* can increase. In turn, gravity can force the guide tubes 133*a*-133*b* to move down the guide posts 123*a*-123*b* of the side supports 119*a*-119*b*, as shown in FIGS. 2A-2B.

Because the upper pivot arms 136*a*-136*b* and the lower pivot arms 139*a*-139*b* are rotatably mounted to the guide tubes 133*a*-133*b*, and because the upper pivot arms 136*a*-136*b* and the lower pivot arms 139*a*-139*a* are also rotatably mounted to the fixed points 143*a*-143*b* and 146*a*-146*b*, moving the guide tubes 133*a*-133*b* down the guide posts 123*a*-123*b* can force the upper pivot arms 136*a*-136*b* and the lower pivot arms 139*a*-139*b* to rotate about the respective fixed points 143*a*-143*b* and 146*a*-146*b*.

As the upper pivot arms 136*a*-136*b* and the lower pivot arms 139*a*-139*b* rotate about the fixed points 143*a*-143*b* and 146*a*-146*b* while the guide tubes 133*a*-133*b* move down the guide posts 123*a*-123*b*, the upper pivot arms 136*a*-136*b* and the lower pivot arms 139*a*-139*b* can force the guide tubes 133*a*-133*b*, and thus the side supports 119*a*-119*b*, to move horizontally forward, away from the lower shelving frame 106.

Thus, when the storage system 100 is transformed from the first configuration shown in FIGS. 1A-1C to the second configuration shown in FIGS. 2A-2B, the upper frame 103 moves downward and forward along with the guide tubes 133*a*-133*b*. In addition, the side supports 119*a*-119*b* move forward, away from the lower shelving frame 106.

Figure 3B:
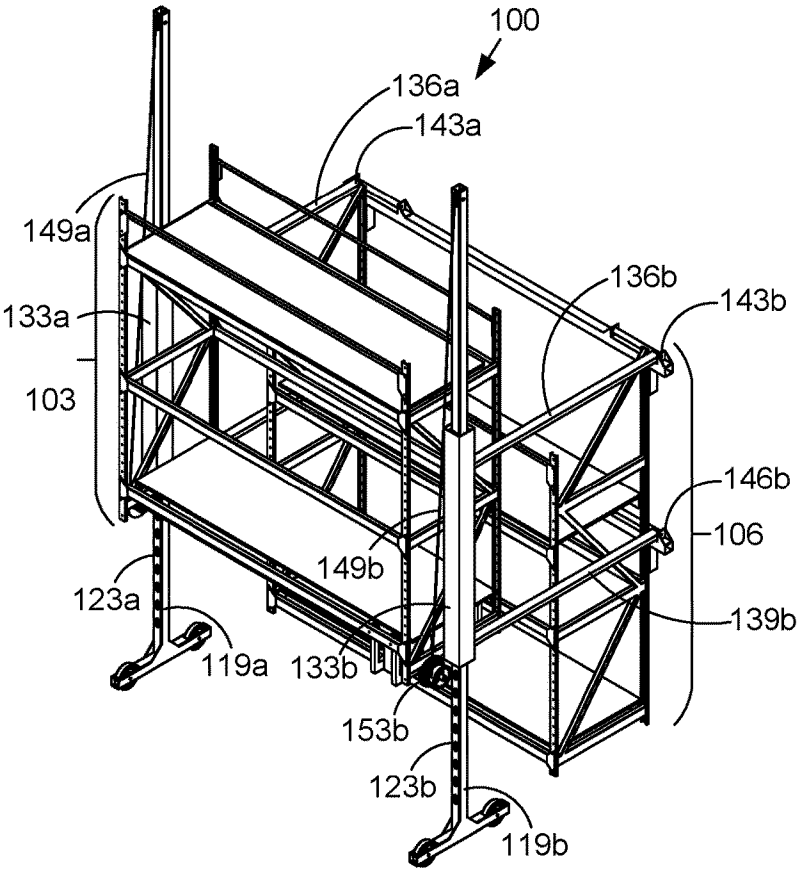
Figure 3A:
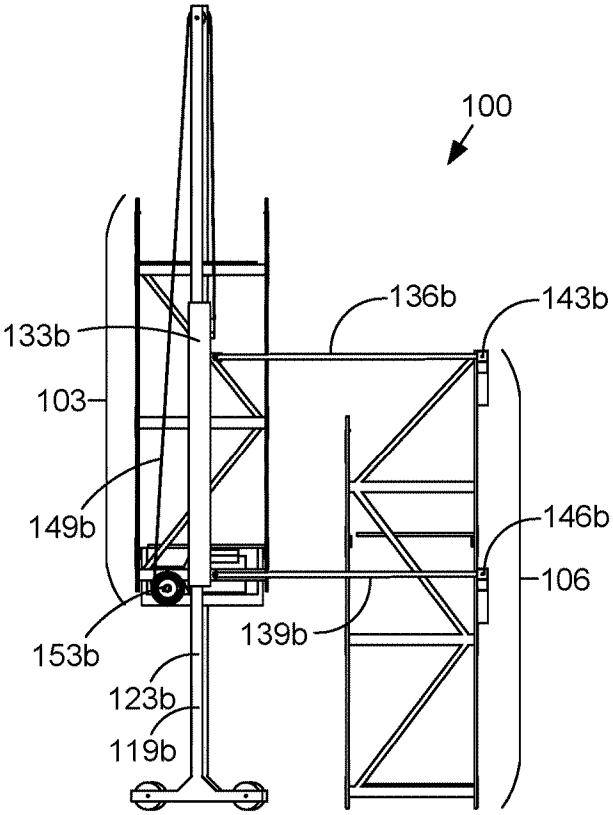

With reference to FIGS. 3A-3B, shown is the storage system 100 as the upper frame 103 continues to be lowered. For the storage system 100 to move from the configuration shown in FIGS. 2A-2B to the configuration shown in FIGS. 3A-3B, the motor 163 can continue to rotate the cable drums 153*a*-153*b* so that the cables 149*a*-149*b* can further unwind from the cable drums 153*a*-153*b*. As a result, the lengths of the portions of the cables 149*a*-149*b* that extend from the cable drums 153*a*-153*b* to the pulleys 159*a*-159*b* can increase. In turn, gravity can force the guide tubes 133*a*-133*b* to move further down the guide post 123*a*-123*b* of the side supports 119*a*-119*b*.

Moving the guide tubes 133*a*-133*b* to the positions shown in FIGS. 3A-3B can force the upper pivot arms 136*a*-136*b* and the lower pivot arms 139*a*-139*b* to further rotate about the respective fixed points 143*a*-143*b* and 146*a*-146*b*. When the storage system 100 is in the configuration shown in FIGS. 3A-3B, the upper pivot arms 136*a*-136*b* and the lower pivot arms 139*a*-139*b* are horizontal.

As the upper pivot arms 136*a*-136*b* and the lower pivot arms 139*a*-139*b* rotate downward to become horizontal, the upper pivot arms 136*a*-136*b* and the lower pivot arms 139*a*-139*b* can force the guide tubes 133*a*-133*b*, and thus the side supports 119*a*-119*b*, to move further forward, away from the lower shelving frame 106. When the upper pivot arms 136*a*-136*b* and the lower pivot arms 139*a*-139*b* are horizontal as shown in FIGS. 3A-3B, the horizontal displacement of the side supports 119*a*-119*b* relative to the rear of the storage system 100 is at its maximum.

Figure 4B:
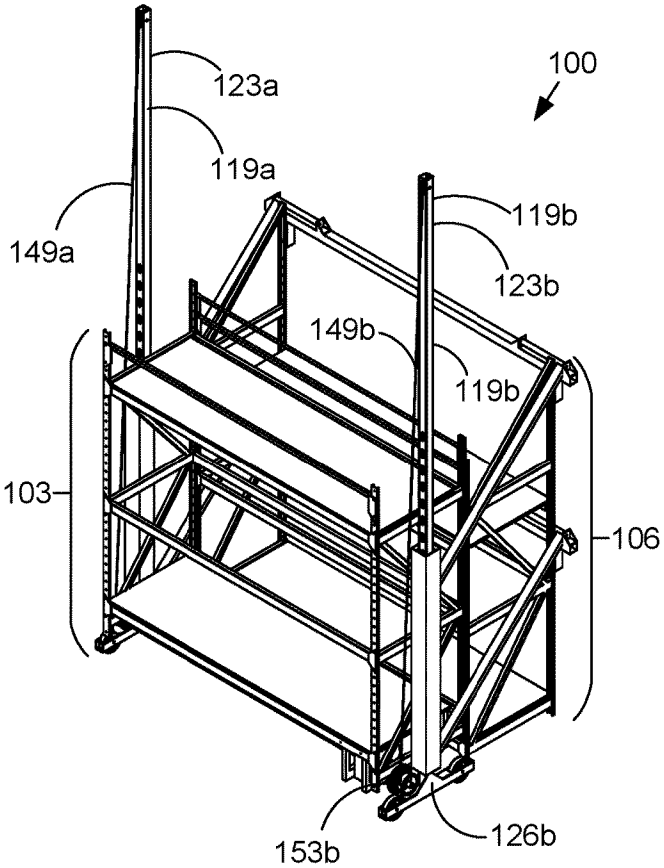
Figure 4A:
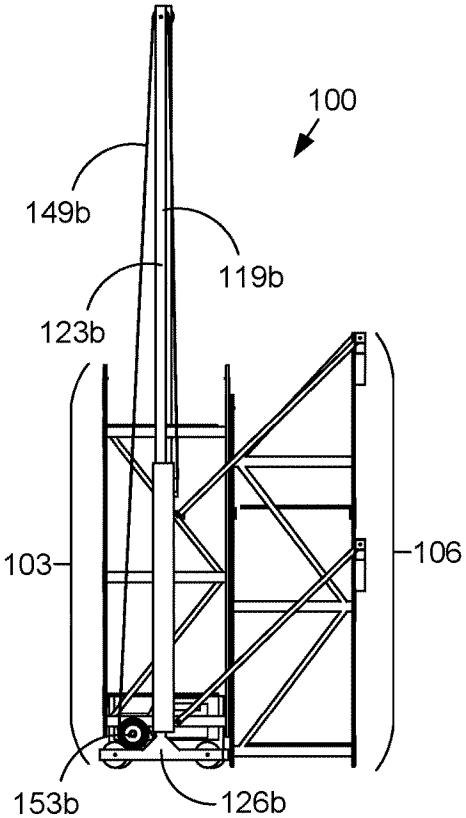

With reference to FIGS. 4A-4B, shown is the storage system 100 as the upper frame 103 continues to be lowered. FIGS. 4A-4B show the storage system 100 with the upper frame 103 is its lowermost position. To move to this position from the position shown in FIGS. 3A-3B, the motor 163 can further rotate the cable drums 153*a*-153*b* so that the cables 149*a*-149*b* further unwind from the cable drums 153*a*-153*b*. As a result, the lengths of the portions of the cables 149*a*-149*b* that extend from the cable drums 153*a*-153*b* to the pulleys 159*a*-159*b* can increase. In turn, gravity can force the guide tubes 133*a*-133*b* to continue to move further down the guide posts 123*a*-123*b* of the side supports 119*a*-119*b*.

Moving the guide tubes 133*a*-133*b* further down the guide posts 123*a*-123*b* can force the upper pivot arms 136*a*-136*b* and the lower pivot arms 139*a*-139*b* to further rotate downward about the respective fixed points 143*a*-143*b* and 146*a*-146*b*. As the upper pivot arms 136*a*-136*b* and the lower pivot arms 139*a*-139*b* rotate about the fixed points 143*a*-143*b* and 146*a*-146*b* from the position in FIGS. 3A-3B to the position shown in FIGS. 4A-4B, the upper pivot arms 136*a*-136*b* and the lower pivot arms 139*a*-139*b* can pull the guide tubes 133*a*-133*b*, and thus the side supports 119*a*-119*b*, backwards, towards the lower shelving frame 106.

Accordingly, as shown in FIGS. 4A-4B, when the storage system 100 is configured so that the upper frame 103 is in the lowermost position, the rear side of the upper frame 103 and the rear end of the feet 126*a*-126*b* can be adjacent to the front side of the lower frame 106.

The upper frame 103 can also be raised so that the storage system 100 moves to the configuration shown in FIGS. 1A-1C, 2A-2C, or 3A-3C. To this end, the motor can rotate the cable drums 153*a*-153*b* so that the cables 149*a*-149*b* are retracted and wound back onto the cable drums 153*a*-153*b*.

Figure 5B:
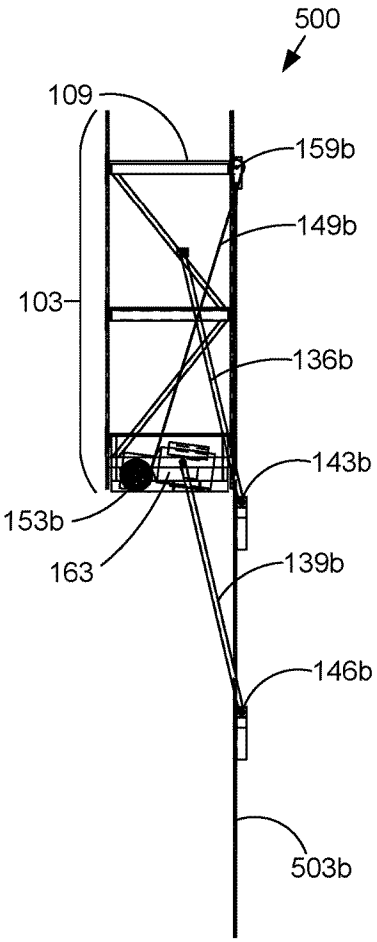
FIG. 5B shows a side view of the storage system of FIG. 5A.
Figure 5A:
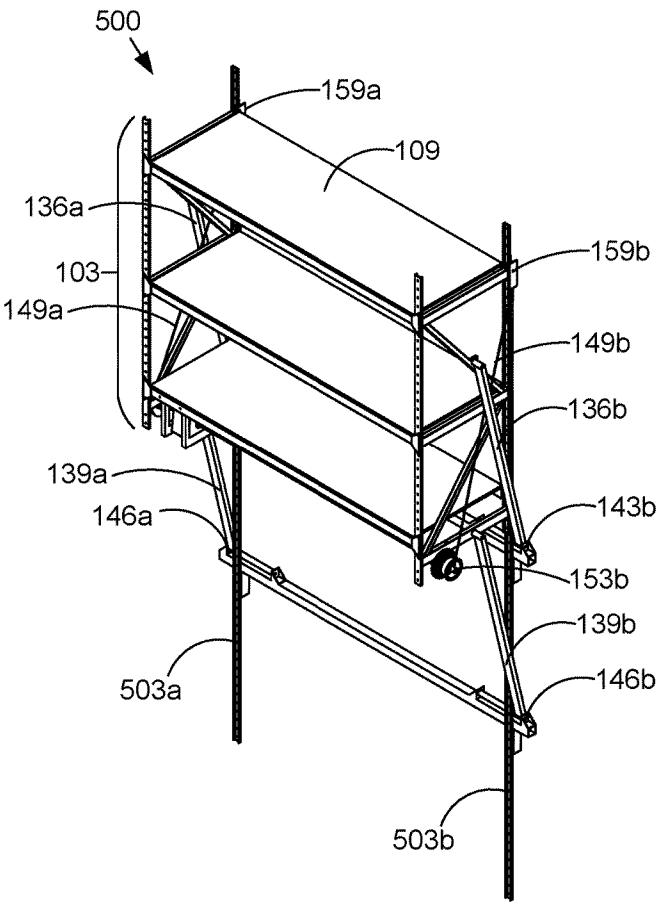
FIG. 5A shows a perspective view of a second example of a storage system according to various embodiments of the present disclosure.

With reference to FIGS. 5A-5B, shown is a second example of a storage system, referred to hereinafter as the storage system 500, according to various embodiments of the present disclosure. In particular, FIG. 5A shows a perspective view and FIG. 5B shows a side view of the storage system 500.

The storage system 500 can include components that are similar to the components of the storage system 100. For example, the storage system 500 can include an upper frame 103, upper pivot arms 136*a*-136*b*, lower pivot arms 139*a*-139*b*, cables 149*a*-149*b*, cable drums 153*a*-153*b*, a rod 156, pulleys 159*a*-159*b*, and a motor 163.

The storage system 500 can also include rear supports 503*a*-503*b*. The rear supports 503*a*-503*b* can mount to a wall or another object that can maintain the rear supports 503*a*-503*b* in position. Although not included in the embodiment illustrated in FIGS. 5A-5B, the storage system 500 in other embodiments can include a lower frame 106.

As shown in FIGS. 5A-5B, the upper pivot arms 136*a*-136*b* can be rotatably mounted to the upper frame 103. For example, the upper pivot arms 136*a*-136*b* can be rotatably mounted directly to a component of the upper frame 103.

Additionally, the upper pivot arms 136*a*-136*b* can be rotatably mounted to fixed points 143*a*-143*b*. In the embodiment shown in FIGS. 5A-5B, the fixed points 143*a*-143*b* are located on the rear supports 503*a*-503*b*. For embodiments that include a lower frame 106, the fixed points 143*a*-143*b* can be located on the lower frame 106. Alternatively, the fixed points 143*a*-143*b* can be located on a wall or other structure.

Similar to the upper pivot arms 136*a*-136*b*, the lower pivot arms 139*a*-139*b* can be rotatably mounted to the upper frame 103. Additionally, the lower pivot arms 139*a*-139*b* can be rotatably mounted to fixed points 146*a*-146*b*. In the embodiment shown in FIGS. 5A-5B, the fixed points 146*a*-146*b* are located on the rear supports 503*a*-503*b*. For embodiments that include a lower frame 106, the fixed points 146*a*-146*b* can be located on the lower frame 106. Alternatively, the fixed points 146*a*-146*b* can be located on a wall or other structure.

For the embodiment shown in FIGS. 5A-5B, the cables 149*a*-149*b* extend from the cable drums 153*a*-153*b*, pass around the rear sides of the pulleys 159*a*-159*b*, and attach to the upper frame 103. By rotating the cable drums 153*a*-153*b*, the motor 163 can retract or extend the cables 149*a*-149*b* to cause the lengths of the portions of the cables 149*a*-149*b* between the cable drums 153*a*-153*b* and the pulleys 159*a*-159*b* to lengthen or shorten. As will be described below, this can cause the upper frame 103 to raise or lower.

In alternative embodiments, other types of systems can cause the upper frame 103 to raise or lower. For example, motors attached to the upper pivot arms 136*a*-136*b* or the lower pivot arms 139*a*-139*b* can cause the upper pivot arms 136*a*-136*b* and the lower pivot arms 139*a*-139*b* to rotate and thereby raise or lower the upper frame 103.

Next, a general description of an example of the operation of the storage system 500 is provided. The following discussion assumes that the storage system 500 is configured in the position shown in FIGS. 5A-5B. In this configuration, the upper frame 103 is positioned above the ground surface with the rear side of the upper frame 103 adjacent to the rear supports 503*a*-503*b*.

Figure 6B:
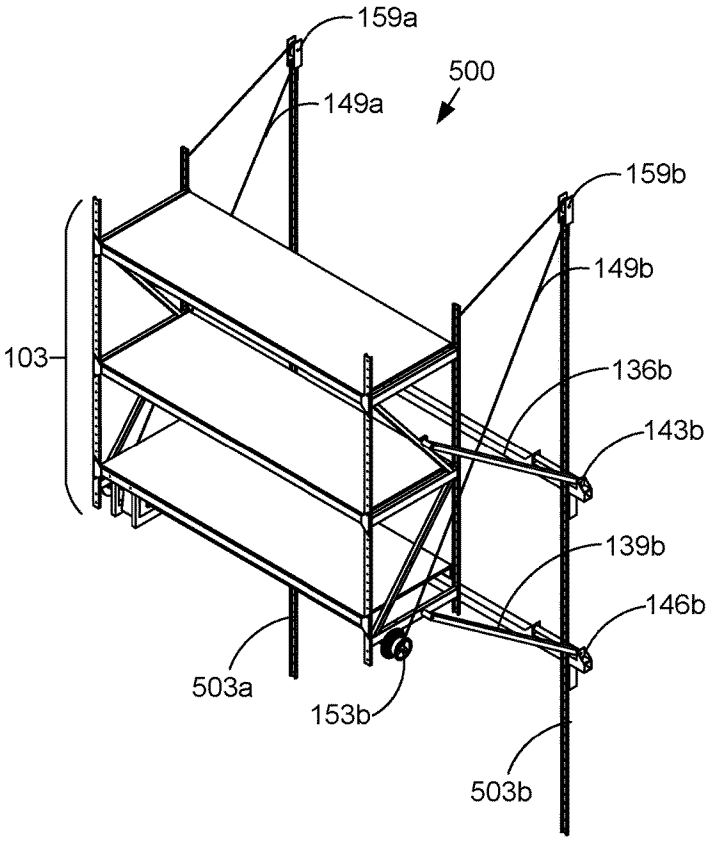
FIGS. 6A-6B, 7A-7B, and 8A-8B show the storage system of FIG. 5A in various configurations.
Figure 6A:
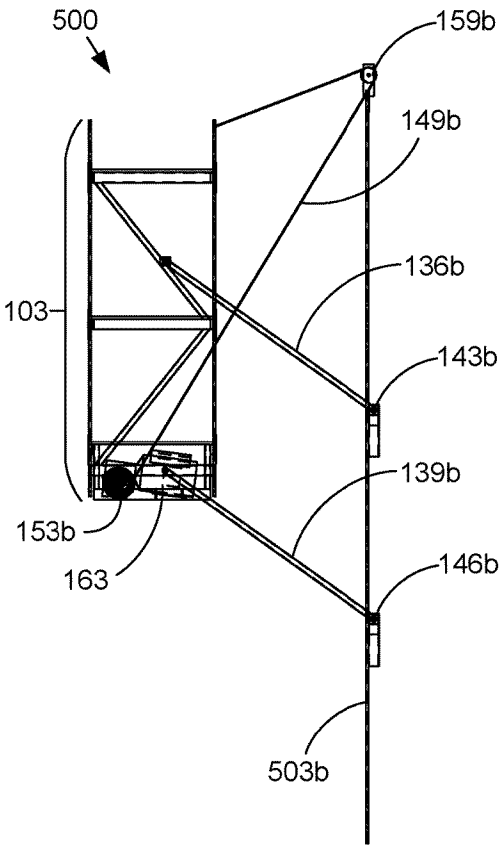

With reference to FIGS. 6A-6B, shown is the storage system 500 as the upper frame 103 is being lowered. For the storage system 500 to move from the configuration shown in FIGS. 5A-5B to the configuration shown in FIGS. 6A-6B, the motor 163 can rotate the cable drums 153*a*-153*b* so that the cables 149*a*-149*b* can partially unwind from the cable drums 153*a*-153*b*. As a result, the lengths of the portions of the cables 149*a*-149*b* that extend from the cable drums 153*a*-153*b* to the pulleys 159*a*-159*b* can increase.

Because the upper pivot arms 136*a*-136*b* and the lower pivot arms 139*a*-139*b* are rotatably mounted to the upper frame 103, and because the upper pivot arms 136*a*-136*b* and the lower pivot arms 139*a*-139*a* are also rotatably mounted to the fixed points 143*a*-143*b* and 146*a*-146*b*, unwinding the cables 149*a*-149*b* from the cable drums 153*a*-153*b* can cause the upper frame 103 to be lowered while the upper pivot arms 136*a*-136*b* and the lower pivot arms 139*a*0139*b* rotate about the fixed points 143*a*-143*b* and 146*a*-146*b*. In addition, as the upper pivot arms 136*a*-136*b* and the lower pivot arms 139*a*-139*b* rotate about the fixed points 143*a*-143*b* and 146*a*-146*b*, the upper pivot arms 136*a*-136*b* and the lower pivot arms 139*a*-139*b* can force the upper frame 103 forward, away from the rear supports 503*a*-503*b*. Thus, the upper frame 103 can remain vertical as the upper frame 103 moves vertically lower and horizontally forward from the position shown in FIGS. 5A-5B.

Figure 7B:
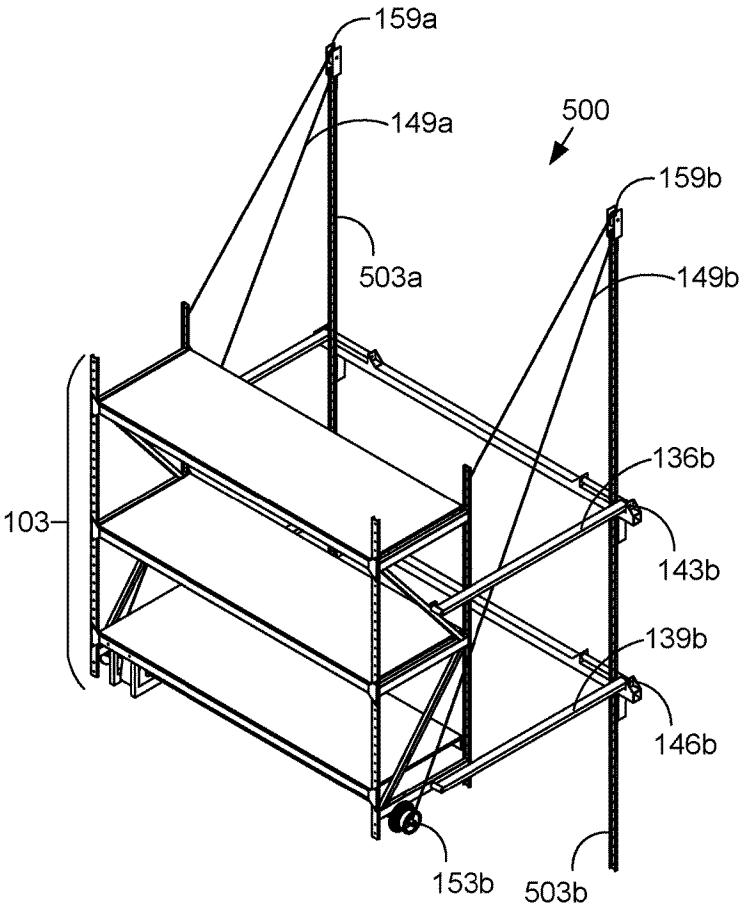
Figure 7A:
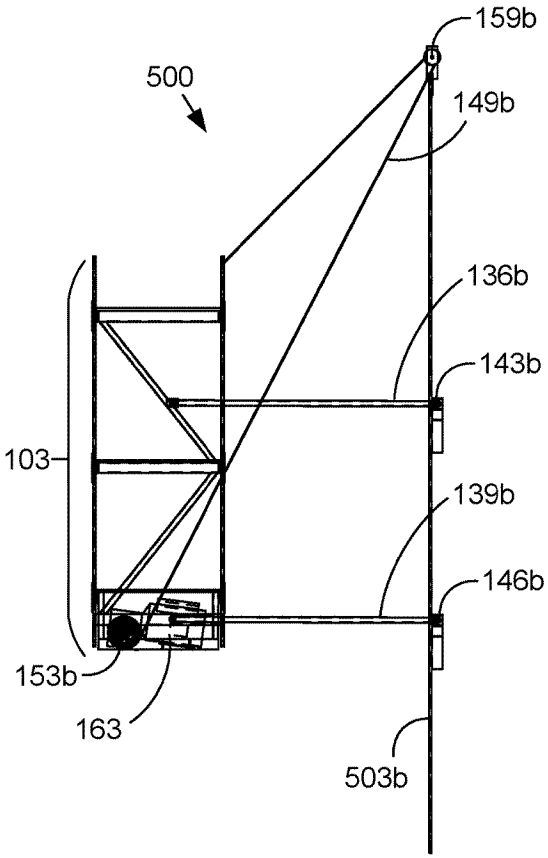

With reference to FIGS. 7A-7B, shown is the storage system 500 as the upper frame 103 continues to be lowered. For the storage system 500 to move from the configuration shown in FIGS. 6A-6B to the configuration shown in FIGS. 7A-7B, the motor 163 can continue to rotate the cable drums 153*a*-153*b* so that the cables 149*a*-149*b* further unwind from the cable drums 153*a*-153*b*. As a result, the lengths of the portions of the cables 149*a*-149*b* that extend from the cable drums 153*a*-153*b* to the pulleys 159*a*-159*b* can increase. In turn, gravity can force the upper frame 103 to be further lowered.

Because the upper pivot arms 136*a*-136*b* and the lower pivot arms 139*a*-139*b* are rotatably mounted to the upper frame 103, and because the upper pivot arms 136*a*-136*b* and the lower pivot arms 139*a*-139*a* are also rotatably mounted to the fixed points 143*a*-143*b* and 146*a*-146*b*, the lowering of the upper frame 103 can cause the upper pivot arms 136*a*-136 and the lower pivot arms 139*a*-139*b* to rotate further about the fixed points 143*a*-143*b* and 146*a*-146*b*. Additionally, the upper pivot arms 136*a*-136*b* and the lower pivot arms 139*a*-139*b* can force the upper frame 103 to continue to move forward, away from the rear supports 503*a*-503*b*. As shown in FIGS. 7A-7B, the upper frame 103 can remain vertical as the upper frame 103 moves vertically lower and horizontally forward from the position shown in FIGS. 7A-7B. In addition, the upper pivot arms 136*a*-136*b* and the lower pivot arms 139*a*-139*b* are horizontal when the storage system 500 is in the configuration shown in FIGS. 7A-7B.

Figure 8B:
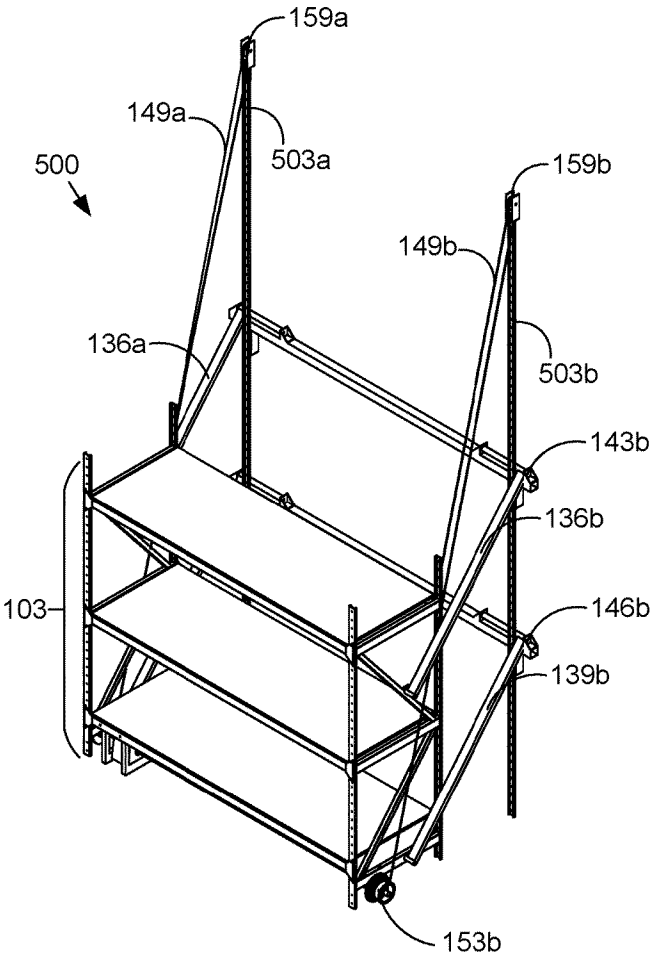
Figure 8A:
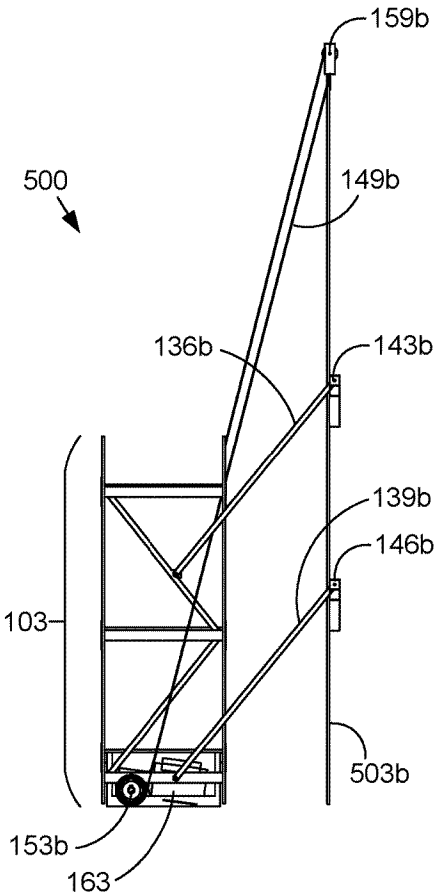

With reference to FIGS. 8A-8B, shown is the storage system 500 as the upper frame 103 of the storage system 500 has continued to be lowered. FIGS. 8A-8B show the storage system 500 with the upper frame 103 in its lowermost position. When the storage system 500 is in the configuration shown in FIGS. 8A-8B, the bottom portion of the upper frame 103 can contact the ground surface.

To move the storage system 500 from the configuration in FIGS. 7A-7B to the configuration shown in FIGS. 7A-7B, the motor 163 can further rotate the cable drums 153*a*-153*b* so that the cables 149*a*-149*b* can further unwind from the cable drums 153*a*-153*b*. As a result, the lengths of the portions of the cables 149*a*-149*b* that extend from the cable drums 153*a*-153*b* to the pulleys 159*a*-159*b* can increase. In turn, gravity can force the upper frame 103 to be further lowered.

Because the upper pivot arms 136*a*-136*b* and the lower pivot arms 139*a*-139*b* are rotatably mounted to the upper frame 103, and because the upper pivot arms 136*a*-136*b* and the lower pivot arms 139*a*-139*a* are also rotatably mounted to the fixed points 143*a*-143*b* and 146*a*-146*b*, the lowering of the upper frame 103 can cause the upper pivot arms 136*a*-136 and the lower pivot arms 139*a*-139*b* to rotate further about the fixed points 143*a*-143*b* and 146*a*-146*b*. Additionally, the upper pivot arms 136*a*-136*b* and the lower pivot arms 139*a*-139*b* can force the upper frame 103 to move backward, towards the rear supports 503*a*-503*b*. As shown in FIGS. 8A-8B, the upper frame 103 can remain vertical as the upper frame 103 moves vertically lower and horizontally backwards from the position shown in FIGS. 7A-7B.

The upper frame 103 can also be raised so that the storage system 500 moves to the configuration shown in FIGS. 5A-5B, 6A-6B, or 7A-7B. To this end, the motor can rotate the cable drums 153*a*-153*b* so that the cables 149*a*-149*b* are retracted by being wound back onto the cable drums 153*a*-153*b*.

Figure 9B:
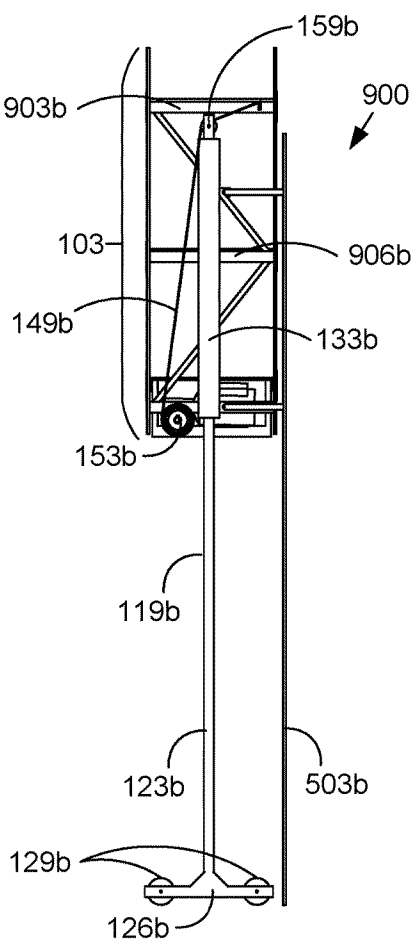
FIG. 9B shows a side view of the storage system of FIG. 9A.
Figure 9A:
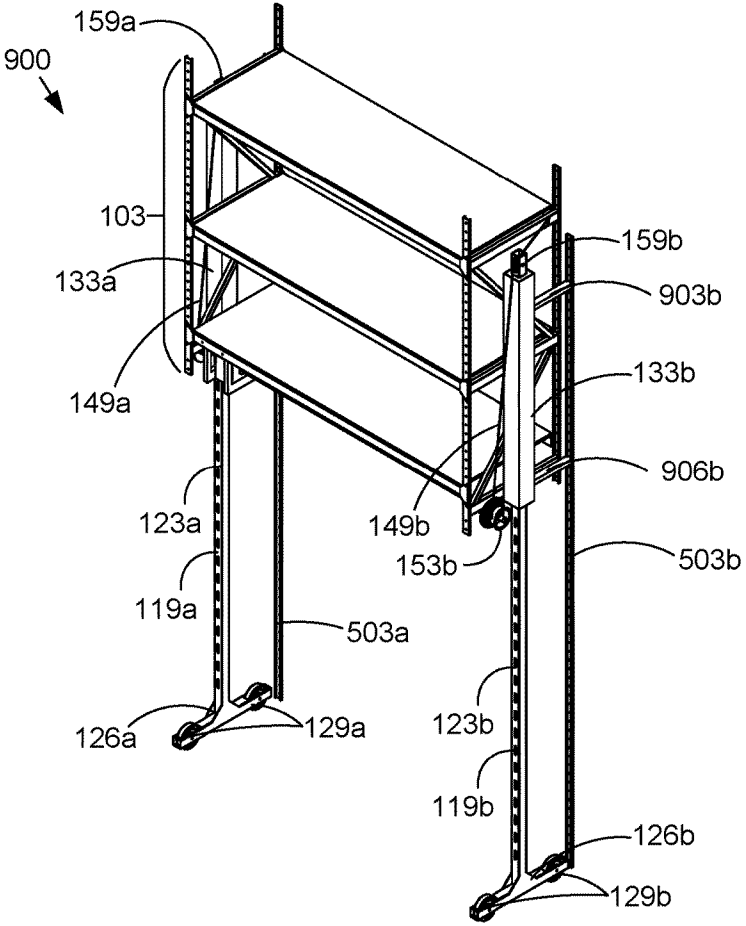
FIG. 9A shows a perspective view of a third example of a storage system according to various embodiments of the present disclosure.

With reference to FIGS. 9A-9B, shown is a third example of a storage system, referred to hereinafter as the storage system 900, according to various embodiments of the present disclosure. In particular, FIG. 9A shows a perspective view, and FIG. 9B shows a side view of the storage system 900.

The storage system 900 can include components that are similar to the components of the storage system 100 and the storage system 500. For example, the storage system 900 can include an upper frame 103, cables 149*a*-149*b*, cable drums 153*a*-153*b*, a rod 156, pulleys 159*a*-159*b*, and a motor 163. In addition, the storage system 900 can include rear supports 503*a*-503*b*. Although not depicted in FIGS. 9A-9B, the storage system 900 can also include a lower frame 106.

Additionally, the storage system 900 can include upper telescoping arms 903*a*-903*b* and lower telescoping arms 906*a*-906*b*. The upper telescoping arms 903*a*-903*b* and the lower telescoping arms 906*a*-906*b* can extend and retract. In some examples, the upper telescoping arms 903*a*-903*b* and the lower telescoping arms 906*a*-906*b* can include linear actuators, such as electric linear actuators or hydraulic linear actuators that can extend and retract the upper telescoping arms 903*a*-903*b* and the lower telescoping arms 906*a*-906*b*. In other embodiments, the upper telescoping arms 903*a*-903*b* and the lower telescoping arms 906*a*-906*b* can be passive arms that can extend or retract when pushed or pulled by another object.

In the embodiment depicted in FIGS. 9A-9B, the upper telescoping arms 903*a*-903*b* and the lower telescoping arms 906*a*-906*b* are configured to stay horizontal. In other words, the angular positions of the upper telescoping arms 903*a*-903*b* and the lower telescoping arms 906*a*-906*b* are fixed relative to the guide tubes 133*a*-133*b* or the rear supports 503*a*-503*b*.

The upper telescoping arms 903*a*-903*b* and the lower telescoping arms 906*a*-906*b* can be attached to the guide tubes 133*a*-133*b*. In alternative embodiments, the upper telescoping arms 903*a*-903*b* and the lower telescoping arms 906*a*-906*b* can be attached to members of the upper frame 103. As will be described in further detail below, the upper telescoping arms 903*a*-903*b* and the lower telescoping arms 906*a*-906*b* can extend or retract to move the upper frame 103 horizontally.

In addition, the upper telescoping arms 903*a*-903*b* and the lower telescoping arms 906*a*-906*b* can be configured to move vertically along the rear supports 503*a*-503*b*. To this end, the rear supports 503*a*-503*b* can include tracks along which the upper telescoping arms 903*a*-903*b* and the lower telescoping arms 906*a*-906*b* can travel.

For the embodiment shown in FIGS. 9A-9B, the cables 149*a*-149*b* extend from the cable drums 153*a*-153*b*, pass around the front sides of the pulleys 159*a*-159*b*, and attach to the upper frame 103. By rotating the cable drums 153*a*-153*b*, the motor 163 can cause the lengths of the portions of the cables 149*a*-149*b* that extend between the cable drums 153*a*-153*b* and the pulleys 159*a*-159*b* to lengthen or shorten. As will be described below, this can cause the upper frame 103 to raise or lower.

Next, a general description of an example of the operation of the storage system 900 is provided. The following discussion assumes that the storage system 900 is configured in the position shown in FIGS. 9A-9B. In this configuration, the upper frame 103 is positioned above the ground surface with the rear side of the upper frame 103 adjacent to the rear supports 503*a*-503*b*.

Figure 10B:
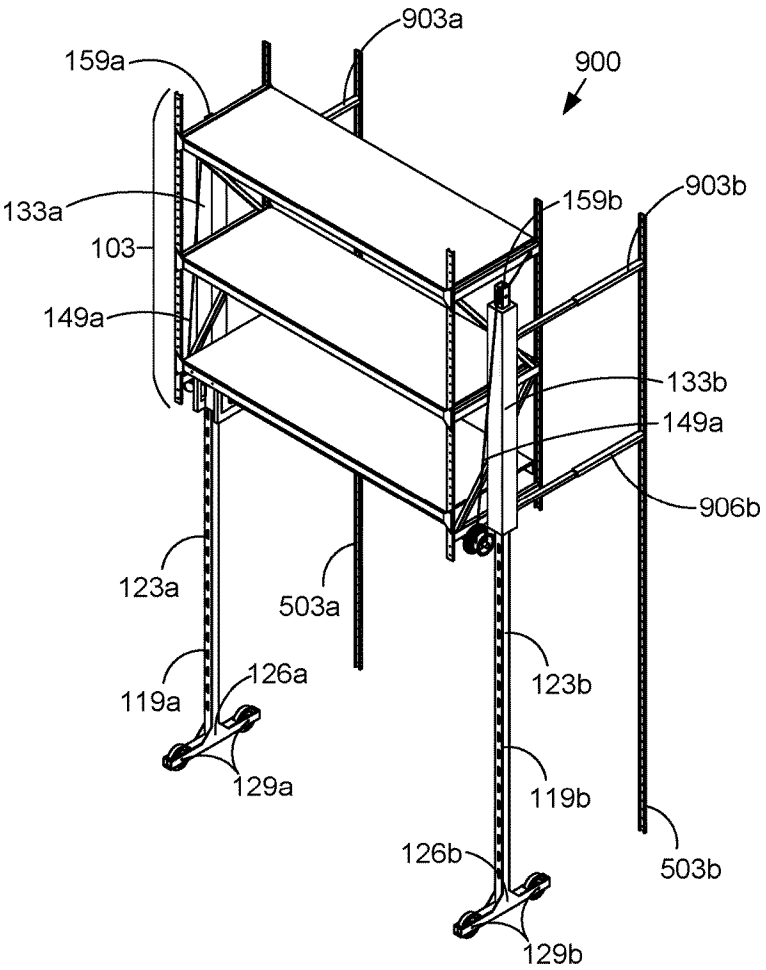
FIGS. 10A-10B and 11A-11B show the storage system of FIG. 9A in various configuration.
Figure 10A:
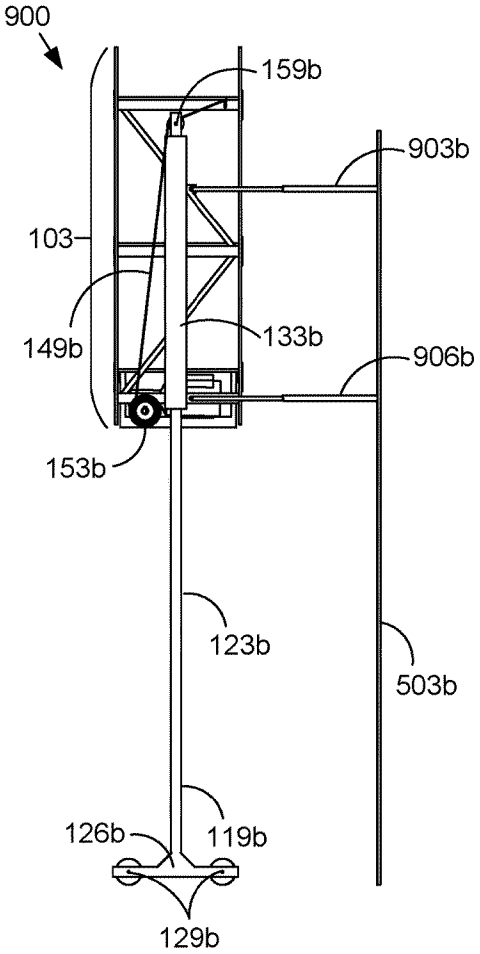

With reference to FIGS. 10A-10B, shown is the storage system 900 after the upper frame 103 has been moved forward, away from the rear supports 503*a*-503*b*. To arrive in this position from the position shown in FIGS. 9A-9B, the upper telescoping arms 903*a*-903*b* and the lower telescoping arms 906*a*-906*b* can extend and push the upper frame 103 forward, away from the rear supports 503*a*-503*b*. Alternatively, a person or machinery can push or pull on the side supports 119*a*-119*b* or the upper frame 103 to force the upper frame 103 to move forward, away from the rear supports 503*a*-503*b*. As discussed above, the side supports 119*a*-119*b* can include wheels 129*a*-129*b* or other components that can facilitate the side supports 119*a*-119*b* and the upper frame 103 moving forward, away from the rear supports 503*a*-503*b*.

Figure 11B:
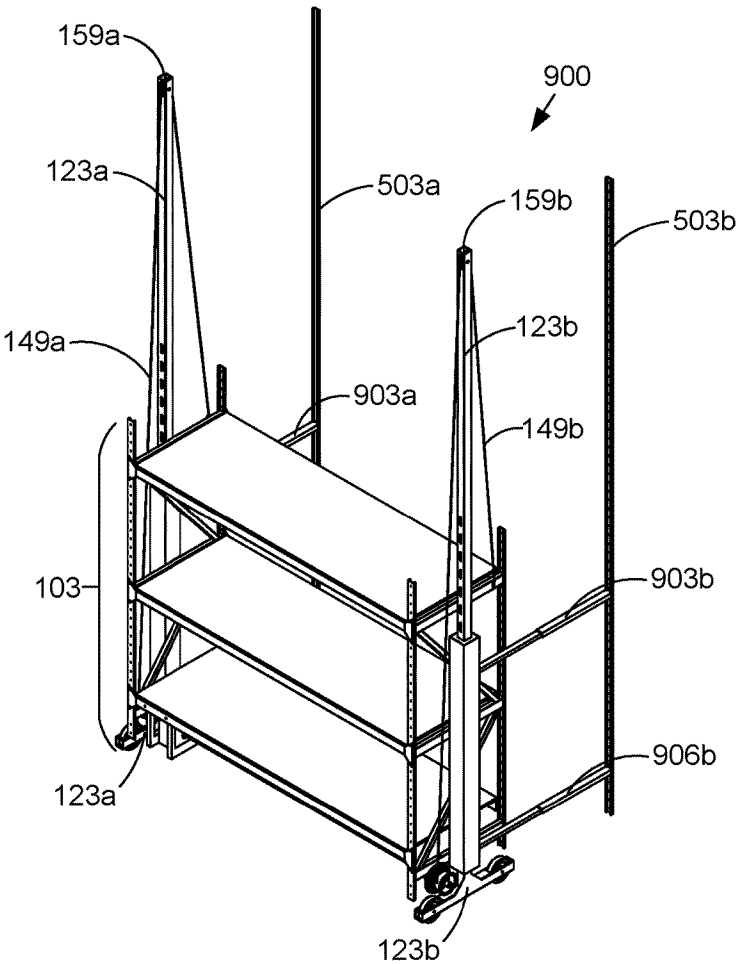
Figure 11A:
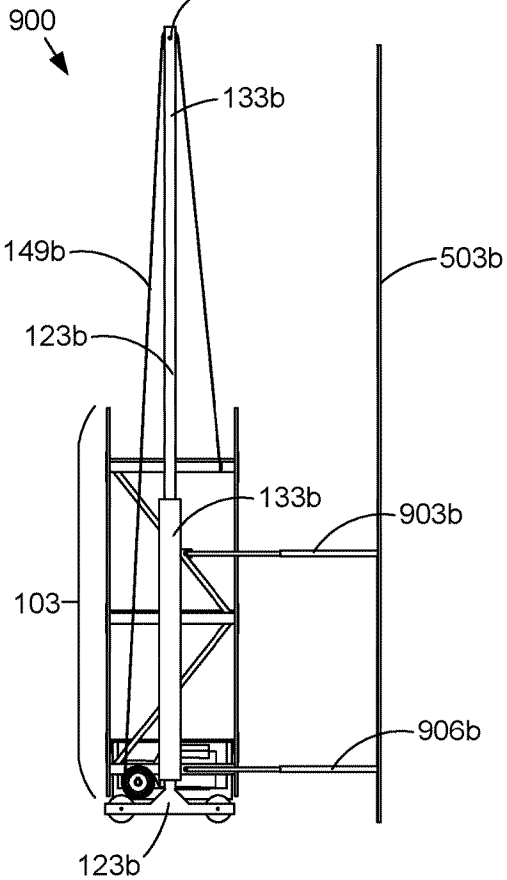

With reference to FIGS. 11A-11B, shown is the storage system 900 after the upper frame 103 has been lowered to its lowermost position. For the storage system 900 to move from the configuration shown in FIGS. 10A-10B to the configuration shown in FIGS. 11A-11B, the motor 163 can rotate the cable drums 153*a*-153*b* so that the cables 149*a*-149*b* partially unwind from the cable drums 153*a*-153*b*. As a result, the lengths of the portions of the cables 149*a*-149*b* that extend from the cable drums 153*a*-153*b* to the pulleys 159*a*-159*b* can increase. In turn, gravity can force the guide tubes 133*a*-133*b* to move down the guide posts 123*a*-123*b* of the side supports 119*a*-119*b*. As shown in FIGS. 11A-11B, when the storage system 900 is configured so that the upper frame 103 is in the lowermost position, the bottom of the upper frame 103 can be adjacent the floor surface, with the upper telescopic arms 903*a*-903*b* and the lower telescopic arms 906*a*-906*b* extended.

The upper frame 103 can also be raised so that the storage system 900 can move to the configuration shown in FIGS. 9A-9B or 10A-10B. To this end, the motor can rotate the cable drums 153*a*-153*b* so that the cables 149*a*-149*b* are retracted and wound back onto the cable drums 153*a*-153*b*. Furthermore, the upper telescoping arms 903*a*-903*b* and the lower telescoping arms 906*a*-906*b* can retract to pull the upper frame 103 back towards the rear supports 503*a*-503*b*.

Figure 12B:
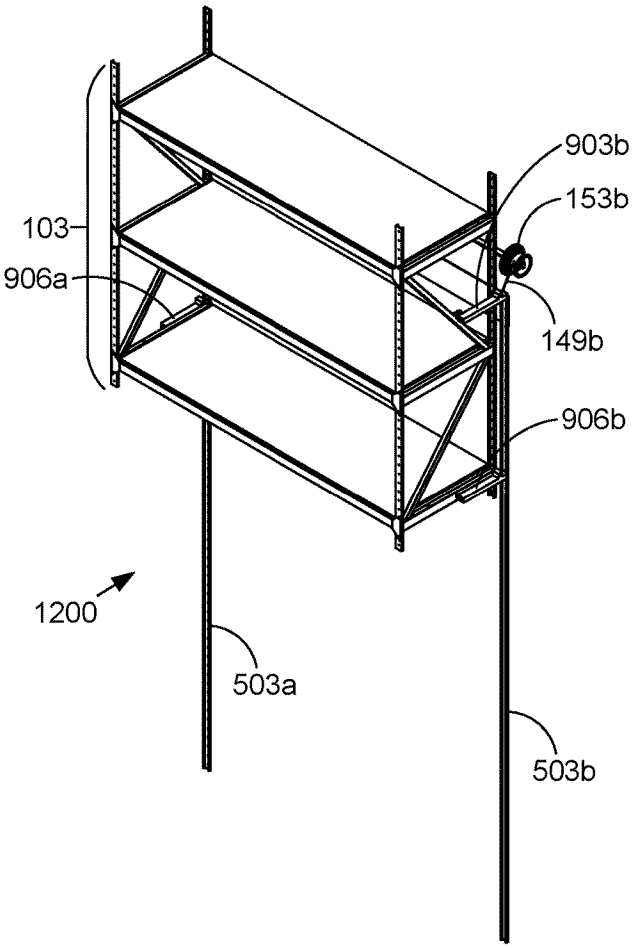
FIG. 12B shows a side view of the storage system of FIG. 12A.
Figure 12A:
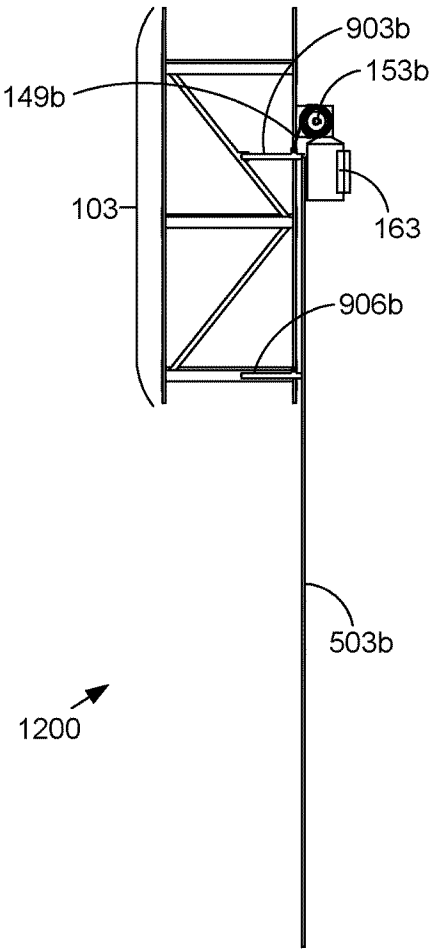
FIG. 12A shows a perspective view of a fourth example of a storage system according to various embodiments of the present disclosure.

With reference to FIGS. 12A-12B, shown is a fourth example of a storage system, referred to hereinafter as the storage system 1200, according to various embodiments of the present disclosure. In particular, FIG. 12A shows a perspective view and FIG. 12B shows a side view of the storage system 1200.

The storage system 1200 can include components that are similar to the components of the storage system 100, the storage system 500, or the storage system 900. For example, the storage system 1200 can include an upper frame 103, cables 149*a*-149*b*, cable drums 153*a*-153*b*, a rod 156, pulleys 159*a*-159*b*, and a motor 163. In addition, the storage system 900 can include rear supports 503*a*-503*b*. Although not depicted in FIGS. 9A-9B, the storage system 900 can also include a lower frame 106.

Furthermore, the storage system 1200 can include upper telescoping arms 903*a*-903*b* and lower telescoping arms 906*a*-906*b*. As discussed above, the upper telescoping arms 903*a*-903*b* and the lower telescoping arms 906*a*-906*b* can extend and retract.

For the embodiment show in FIGS. 12A-12B, the upper telescoping arms 903*a*-903*b* and the lower telescoping arms 906*a*-906*b* can be attached directly to the upper frame 103. The upper telescoping arms 903*a*-903*b* and the lower telescoping arms 906*a*-906*b* can extend or retract to move the upper frame 103 horizontally.

The upper telescoping arms 903*a*-903*b* and the lower telescoping arms 906*a*-906*b* can also be configured to move vertically along the rear supports 503*a*-503*b*. To this end, the rear supports 503*a*-503*b* can include tracks along which the upper telescoping arms 903*a*-903*b* and the lower telescoping arms 906*a*-906*b* can travel.

For the embodiment shown in FIGS. 12A-12B, the cable drums 153*a*-153*b* can be mounted to the rear side of the upper frame 103 above the upper telescoping arms 903*a*-903*b*. The cables 149*a*-149*b* in the embodiment shown in FIGS. 12A-12B extend from the cable drums 153*a*-153*b* and attach to the upper telescoping arms 903*a*-903*b*. In alternative embodiments, the cables 149*a*-149*b* can attach to the upper frame 103 or the lower telescoping arms 906*a*-906*b*. By rotating the cable drums 153*a*-153*b*, the motor 163 can cause the lengths of the portions of the cables 149*a*-149*b* that extend to the upper telescoping arms 903*a*-903*b* to lengthen or shorten. As will be described below, this can cause the upper frame 103 to raise or lower.

Next, a general description of an example of the operation of the storage system 1200 is provided. The following discussion assumes that the storage system 1200 is configured in the position shown in FIGS. 12A-21B. In this configuration, the upper frame 103 is positioned above the ground surface with the rear side of the upper frame 103 adjacent to the rear supports 503*a*-503*b*.

Figure 13B:
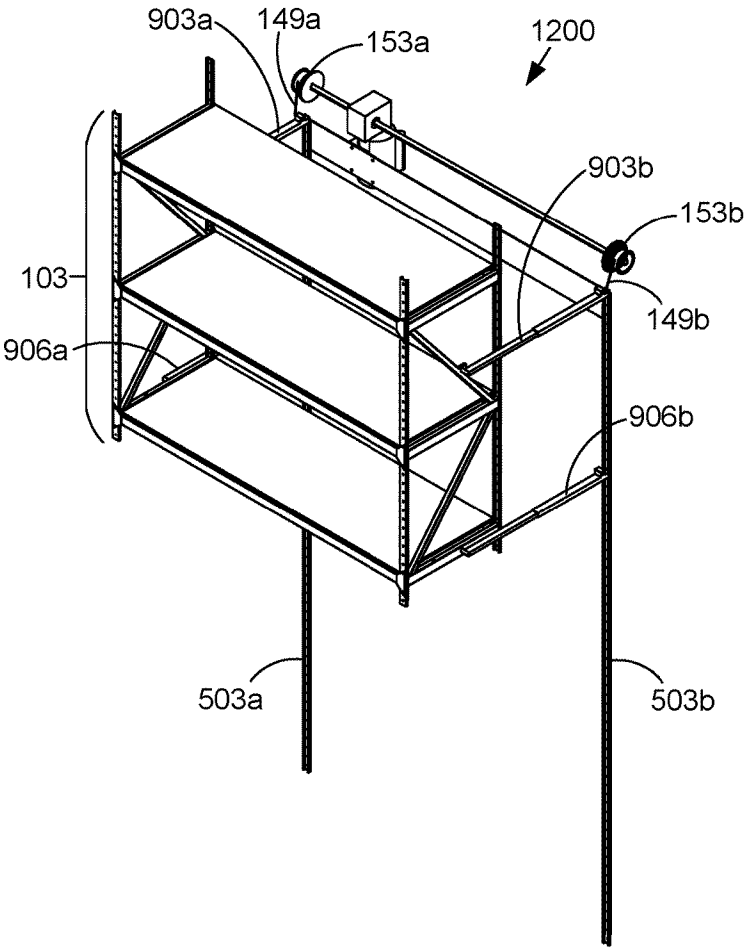
FIGS. 13A-13B and 14A-14B show the fourth storage system of FIGS. 12A-12 in various configuration.
Figure 13A:
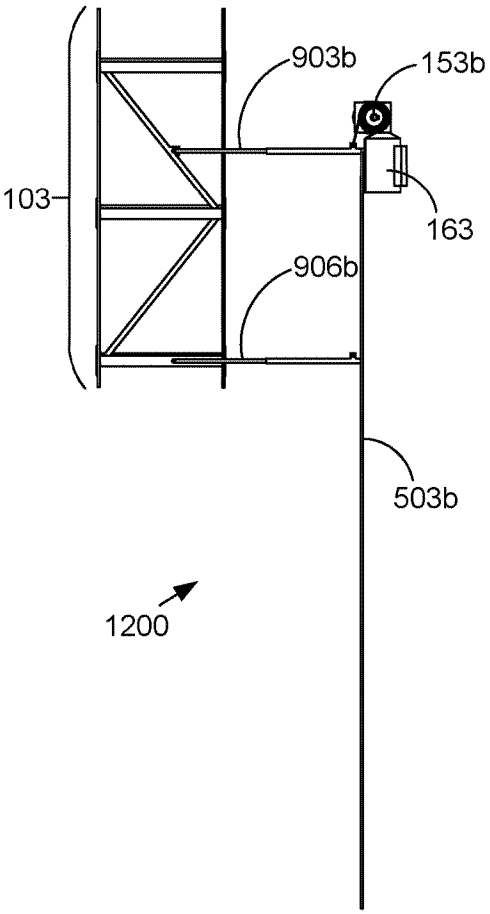

With reference to FIGS. 13A-13B, shown is the storage system 1200 after the upper frame 103 has been moved forward, away from the rear supports 503*a*-503*b*. To arrive in this position from the position shown in FIGS. 12A-12B, the upper telescoping arms 903*a*-903*b* and the lower telescoping arms 906*a*-906*b* can extend and push the upper frame 103 forward, away from the rear supports 503*a*-503*b*. Alternatively, a person or machinery can push or pull on the upper frame 103 to force the upper frame 103 to move forward, away from the rear supports 503*a*-503*b*.

Figure 14B:
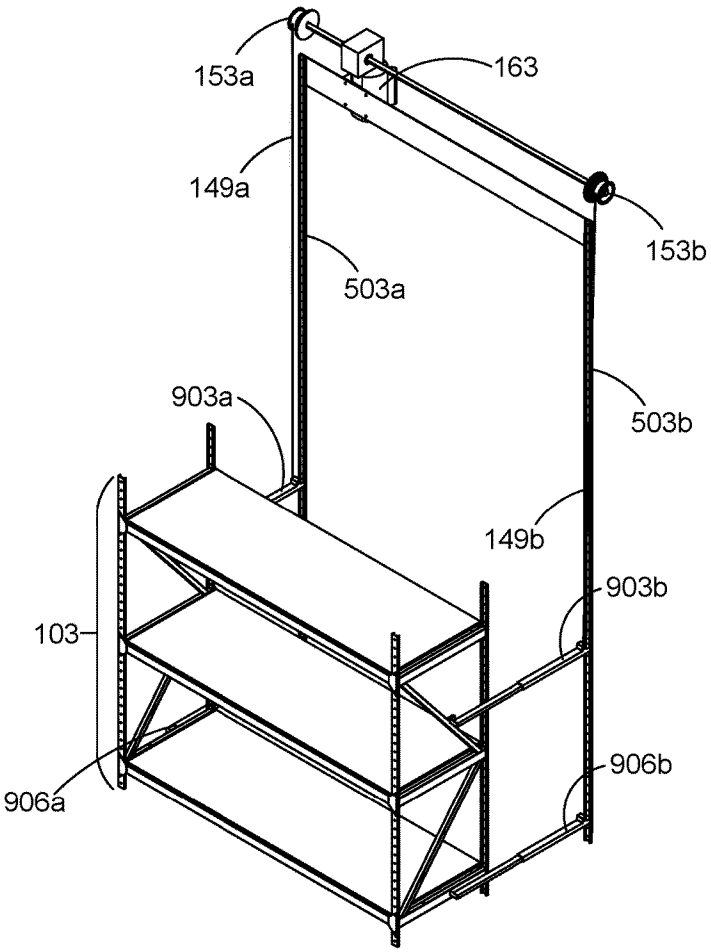
Figure 14A:
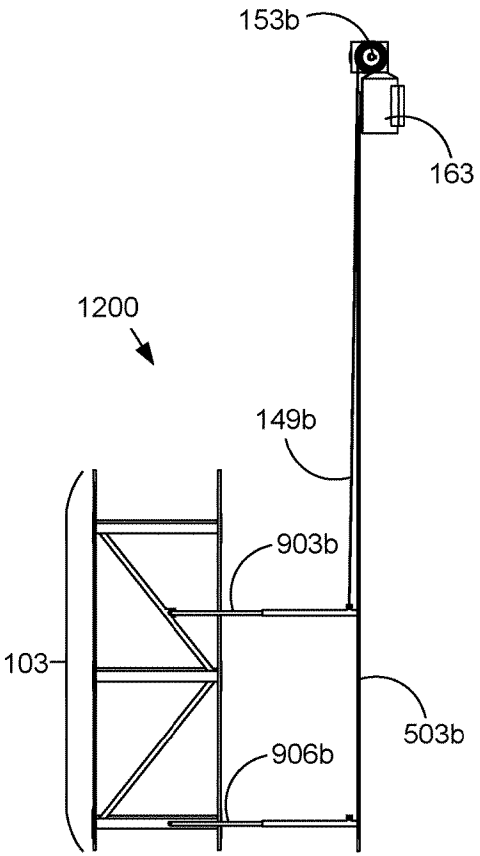

With reference to FIGS. 14A-14B, shown is the storage system 1200 after the upper frame 103 has been lowered to its lowermost position. For the storage system 1200 to move from the configuration shown in FIGS. 13A-13B to the configuration shown in FIGS. 14A-14B, the motor 163 can rotate the cable drums 153*a*-153*b* so that the cables 149*a*-149*b* partially unwind from the cable drums 153*a*-153*b*. As a result, the lengths of the portions of the cables 149*a*-149*b* that extend from the cable drums 153*a*-153*b* to the upper telescoping arms 903*a*-903*b* can increase. In turn, gravity can force the upper frame 103 to move downward, with the upper telescoping arms 903*a*-903*b* and the lower telescoping arms 906*a*-906*b* sliding down the rear supports 503*a*-503*b*. As shown in FIGS. 14A-14B, when the storage system 1200 is configured so that the upper frame 103 is in the lowermost position, the bottom of the upper frame 103 can be adjacent the floor surface, with the upper telescopic arms 903*a*-903*b* and the lower telescopic arms 906*a*-906*b* extended.

The upper frame 103 can also be raised so that the storage system 900 moves to the configuration shown in FIGS.

12A-12B or 13A-13B. To this end, the motor can rotate the cable drums 153*a*-153*b* so that the cables 149*a*-149*b* are retracted and wound back onto the cable drums 153*a*-153*b*. The upper telescopic arms 903*a*-903*b* and the lower telescopic arms 906*a*-906*b* can also retract to pull the upper frame 103 back towards the rear supports 503.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language, such as the phrase "at least one of X, Y, Z," unless indicated otherwise, is used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

The above-described embodiments of the present disclosure are merely possible examples of implementations set forth for a clear understanding of the principles of the present disclosure. Many variations and modifications can be made to the above-described embodiments without departing substantially from the spirit and principles of the disclosure. In addition, components and features described with respect to one embodiment can be included in another embodiment. All such modifications and variations are intended to be included herein within the scope of this disclosure.

Therefore, the following is claimed:

1. A system, comprising:

an upper frame;

at least one of a lower frame or a rear frame;

a first guide tube and a second guide tube that support the upper frame;

a first pivot arm having a proximal end and a distal end relative to the first guide tube, the proximal end of the first pivot arm being rotatably coupled to the first guide tube, the distal end of the first pivot arm being rotatably coupled to a first fixed pivot point proximate to at least one of the lower frame or the rear frame;

a second pivot arm having a proximal end and a distal end relative to the second guide tube, the proximal end of the second pivot arm being rotatably coupled to the second guide tube, the distal end of the second pivot arm being rotatably coupled to a second fixed pivot point proximate to at least one of the lower frame or the rear frame;

a first side support that contacts and travels horizontally across a floor surface, the first side support comprising a first guide post, the first guide post being inserted into the first guide tube, the first guide tube being configured to move vertically along the first guide post; and a second side support that contacts and travels horizontally across the floor surface, the second side support comprising a second guide post, the second guide post being inserted into the second guide tube, the second guide tube being configured to move vertically along the second guide post.

2. The system of claim 1, further comprising means for moving the first guide tube vertically along the first guide post and for moving the second guide tube vertically along the second guide post.

3. The system of claim 2, wherein the means for moving the first guide tube vertically along the first guide post and for moving the second guide tube vertically along the second guide post comprises a motor and a cable.

4. The system of claim 2, wherein the means for moving the first guide tube vertically along the first guide post and for moving the second guide tube vertically along the second guide post comprises a motor that rotates at least one of the first pivot arm or the second pivot arm.

5. The system of claim 1, further comprising:

a third pivot arm having a proximal end and a distal end relative to the first guide tube, the proximal end of the third pivot arm being rotatably coupled to the first guide tube, the distal end of the third pivot arm being rotatably coupled to a third fixed pivot point proximate to the lower frame; and a fourth pivot arm having a proximal end and a distal end relative to the second guide tube, the proximal end of the fourth pivot arm being rotatably coupled to the second guide tube, the distal end of the fourth pivot arm being rotatably coupled to a fourth fixed pivot point proximate to the lower frame.

6. A system, comprising:

an upper frame;

a guide tube that supports the upper frame;

a pivot arm having a proximal end and a distal end relative to the guide tube, the proximal end of the pivot arm being rotatably coupled to the guide tube, the distal end of the pivot arm being rotatably coupled to a fixed pivot point;

a side support that contacts and travels horizontally across a floor surface, the side support comprising a guide post, the guide post being inserted into the guide tube, the guide tube being configured to move vertically along the guide post, wherein the upper frame moves horizontally and vertically when the guide tube is moved vertically along the guide post; and means for moving the guide tube along the guide post, wherein the means for moving the guide tube along the guide post comprises at least one of a linkage attached to the guide tube or a pulley.

7. The system of claim 6, wherein the linkage comprises a cable attached to the guide tube.

8. The system of claim 6, wherein the system further comprises a lower frame.

9. The system of claim 8, further comprising an additional pivot arm that is rotatably coupled to the guide tube and to the lower frame.

10. The system of claim 6, wherein the side support further comprises a wheel that facilitates the side support moving horizontally as the guide tube is moved along the guide post.

11. A method, comprising:

positioning a storage system in a first configuration, wherein the storage system comprises:

an upper frame;

a guide tube that supports the upper frame;

a pivot arm having a proximal end and a distal end relative to the guide tube, the proximal end of the pivot arm being rotatably coupled to the guide tube, the distal end of the pivot arm being rotatably coupled to a pivot point;

a side support that contacts and travels horizontally across a floor surface, the side support comprising a guide post, the guide post being inserted into the guide tube, the guide tube being configured to move vertically along the guide post, wherein the upper frame moves horizontally and vertically when the guide tube is moved vertically along the guide post; and means for moving the guide tube along the guide post, wherein the means for moving the guide tube along the guide post comprises at least one of a linkage attached to the guide tube or a pulley; and positioning the storage system in a second configuration using the means for moving the guide tube along the guide post.

12. The method of claim 11, wherein the upper frame is raised above the floor surface when the storage system is in the first configuration.

13. The method of claim 11, wherein the side support travels horizontally across the floor surface by at least rolling a wheel.

14. The method of claim 11, wherein positioning the storage system in the second configuration comprises rotating a cable drum.

15. The method of claim 11, wherein positioning the storage system in the second configuration comprises extending or retracting a linear actuator.

* * * * *